US007798922B2

(12) United States Patent
Oresky

(10) Patent No.: US 7,798,922 B2
(45) Date of Patent: Sep. 21, 2010

(54) SYSTEM AND METHOD FOR SELECTIVELY MARKING OBJECTS

(76) Inventor: Darrell Oresky, 6420 John Jackson Ct., Fairfax Station, VA (US) 22039

( * ) Notice: Subject to any disclaimer, the term of this patent is extended or adjusted under 35 U.S.C. 154(b) by 254 days.

(21) Appl. No.: 12/100,767

(22) Filed: Apr. 10, 2008

(65) Prior Publication Data

US 2008/0254920 A1 Oct. 16, 2008

Related U.S. Application Data

(60) Provisional application No. 60/922,845, filed on Apr. 11, 2007.

(51) Int. Cl.
*A63B 67/00* (2006.01)
*A63C 19/06* (2006.01)

(52) U.S. Cl. ..... 473/490

(58) Field of Classification Search ..... 473/490; 362/559

See application file for complete search history.

(56) References Cited

U.S. PATENT DOCUMENTS 4,090,708 A * 5/1978 McPeak ..... 33/289
5,976,039 A * 11/1999 Epel et al. ..... 473/490
6,784,603 B2 * 8/2004 Pelka et al. ..... 313/113
6,895,677 B2 * 5/2005 Dinicola ..... 33/289
2008/0254920 A1 * 10/2008 Oresky ..... 473/490
2009/0197710 A1 * 8/2009 Ronda ..... 473/490

* cited by examiner

*Primary Examiner*—Raleigh W. Chiu
(74) *Attorney, Agent, or Firm*—The Marbury Law Group, PLLC

(57) ABSTRACT

A surface is selectively marked by using a coating containing quantum dots. When exposed to an energizing source, the quantum dots emit colored light to selectively mark the surface. In an embodiment, a green artificial turf field is marked with two sets of lines, white for football and yellow for soccer. The football lines are normally visible, but are also embedded with quantum dots that emit green light when energized. The soccer lines are normally invisible (clear), but emit yellow light when energized. The field can be used for football without energizing the quantum dots. To use the field for soccer, the field is exposed to a constant source of UVC energy. The quantum dots in the football lines emit green light when energized, causing them to become green, blending in with the normal green color of the artificial turf field. The quantum dots in the soccer lines emit yellow light when energized. Only the soccer lines are then visible, thus eliminating confusion for the players and officials.

20 Claims, 6 Drawing Sheets

SYSTEM AND METHOD FOR SELECTIVELY MARKING OBJECTS

RELATED APPLICATIONS

This application claims the benefit of U.S. Provisional Application Ser. No. 60/922,845, filed Apr. 11, 2007, which is hereby incorporated by reference.

BACKGROUND

This invention relates generally to the use of quantum dots to allow for turning on and off, at will, markings on objects or surfaces. More particularly, this invention relates to a method and apparatus for displaying only the appropriate field markings on a multi-use athletic field.

More and more artificial turf athletic fields are being installed, in many cases as replacements for natural grass fields, due to reduced long term maintenance costs, long life time, and greater utilization rates because of the ability to use the fields in all weather conditions.

Artificial turf fields are frequently permanently painted with field markings for multiple sports (i.e. football, soccer, and lacrosse). The lines for each sport are painted in a different color (i.e. white, yellow, and blue, respectively).

The multitude of lines on the field can cause confusion for both the players and the officials. For example, a soccer field is slightly wider than a football field. At times, soccer players may believe the ball has exited the playing field when it has gone outside the white lines, when in fact the yellow soccer side line is 8-10 feet further out.

There is currently no solution that would allow only the lines appropriate for the sport being played to be displayed, hiding the lines for the other sports, short of constantly repainting the lines, which is cost and time prohibitive.

What would really be useful is a system that would allow for all lines to be permanently painted onto the field, but for only those that are necessary for the sport being played to be displayed at that time.

SUMMARY

Disclosed embodiments are able to selectively control the display of markings on an object or surface.

Disclosed embodiments allow for the selective control of the display of markings on an object or surface to occur without impacting other existing functionality of the object or surface.

Disclosed embodiments reduce confusion among users of an object by selectively displaying only the appropriate markings for the particular use of a multi-use object or surface.

Disclosed embodiments selectively control the display of markings on an object in a way that is not harmful to humans or animals when in proximity of the object or surface.

Disclosed embodiments selectively control the display of markings on an object or surface in a way that does not interfere with any existing electromagnetically controlled devices in proximity of the object or surface.

Disclosed embodiments selectively control the display of markings on an object or surface in a way that does not interfere with any existing electromagnetic emissions from devices in proximity of the object or surface.

Disclosed embodiments reduce the present costs, in both time required and materials necessary, of adjusting a multi-use object or surface for a particular use.

Quantum dots are used to implement the various embodiments. Quantum dots are semiconductor compounds of very small size (~2-10 nm) that, when energized, emit energy in the visible light range (400-700 nm), dependent on the size and material of the quantum dot. As such, quantum dots can be specifically created to emit a desired color.

A green artificial turf field has two sets of lines, e.g., white for football and yellow for soccer. The football lines are normally visible, but are also embedded with quantum dots that emit green light when energized. The soccer lines are normally invisible (clear), but emit yellow light when energized. The field can be used for football without using the quantum dots. To use the field for soccer, the field is exposed to a constant source of UVC energy. The quantum dots in the football lines will emit green light, causing them to become green, blending in with the normal color of the field. The quantum dots in the soccer lines will emit yellow light. Only the soccer lines are visible, eliminating confusion for the players and officials.

Using the tunable absorption properties of quantum dots, multiple colors can be used, each invisible when not energized. When the field is exposed to the specific absorption wavelength appropriate for the required quantum dots, only the lines required for the situation will appear.

Such a system has numerous applications beyond indoor (domed) or outdoor athletic fields, to include indoor sports floors (gymnasiums, field houses), multi-use parking lots, or essentially any object which could be improved by being able to selectively choose which markings, either in the singular or multiple, are displayed.

DETAILED DESCRIPTION

Figure 1:
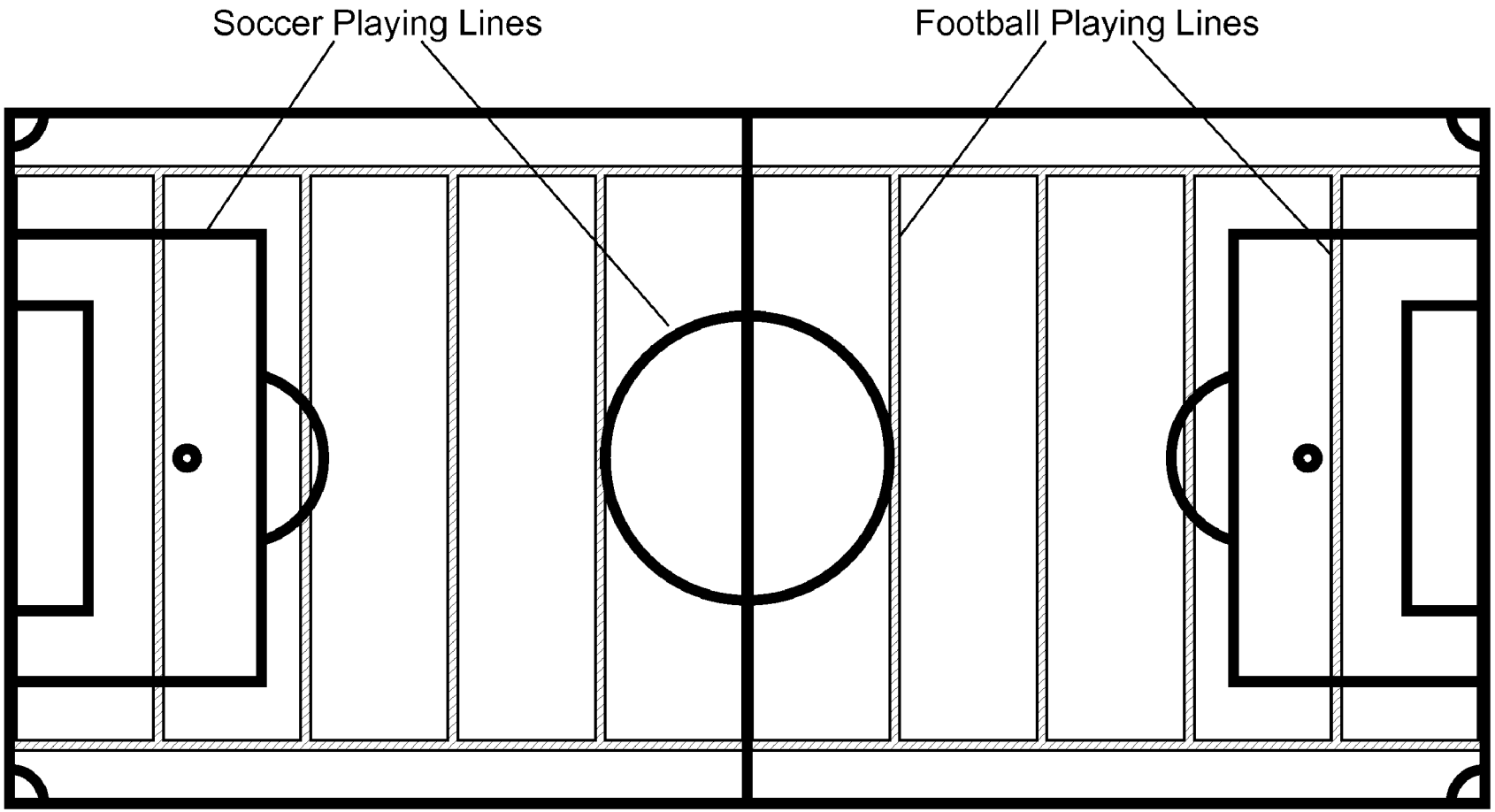
FIG. 1 is a top down view of a typical prior art sports field with markings for multiple sports.

Quantum dots are used to implement the various embodiments. Quantum dots are semiconductor compounds of very small size (2-10 nm). An interesting property of quantum dots is that when energized, they in return emit energy in the visible light range (about 400-700 nm). Further, the emitted wavelength of light is dependent on the size and material of the quantum dot. Essentially, quantum dots can be specifically created to emit a desired color.

In contrast to bulk semiconductors which display a rather uniform absorption spectrum, the absorption spectrum for quantum dots appears as a series of overlapping peaks that get larger at shorter wavelengths. Owing once more to the discrete nature of electron energy levels in quantum dots, each peak corresponds to an energy transition between discrete electron-hole (exciton) energy levels. The dots will not absorb light that has a wavelength longer than that of the first exciton peak, also referred to as the absorption onset. Like all other optical and electronic properties, the wavelength of the first exciton peak (and all subsequent peaks) is a function of the composition and size of the dot. Smaller dots result in a first exciton peak at shorter wavelengths.

The peak emission wavelength is bell-shaped (Gaussian) and occurs at a slightly longer wavelength than the lowest energy exciton peak (the absorption onset). This energy separation is what is referred to as the Stoke's Shift. Another interesting property of quantum dots is that the peak emission wavelength is independent of the wavelength of the excitation light, assuming that it is shorter that the wavelength of the absorption onset. The bandwidth of the emission spectra, denoted as the Full Width at Half Maximum (FWHM) stems from the temperature, natural spectral line width of the dots, and the size distribution of the population of dots within a solution or matrix material. Spectral emission broadening due to size distribution is known as inhomogeneous broadening and is the largest contributor to the FWHM. Narrower size distributions yield smaller FWHM. For CdSe a 5% size distribution corresponds to FWHM of about 30 nm while in PbSe a 5% size distribution corresponds to FWHM of about 100 nm.

For a quantum dot to emit visible light, the energy which energizes it must be of a wavelength shorter than the dot's emission wavelength. This absorption range, which can also be tuned, in general requires the quantum dot to be energized with energy in the ultraviolet wavelengths (below 400 nm). Although current quantum dot technology has this energizing wavelength requirement, future technology advances may allow quantum dots to be energized with other wavelengths. For example, RF energizing of a quantum dot is contemplated as a desirable, although currently unrealized, possibility.

Ultraviolet light is a natural component of sunlight. There are three types of ultraviolet light—UVA (350-400 nm), UVB (280-350 nm), and UVC (below 280 nm). All three types are found in sunlight. However, only UVA and UVB reach the surface of the earth—UVC rays are absorbed by the atmosphere. UVC rays, however, can be artificially generated using UV lamps, and can penetrate the atmosphere to a certain extent. By taking advantage of the tunable absorption properties of quantum dots, dots that absorb only in the range of 280 nm or below can be created, which will not be affected by ambient UVA and UVB rays from sunlight.

However, most sources of UVC radiation are generally considered dangerous to living organisms at levels greater than 0.1 $\mu W/cm^2$ (and as such are used for sterilization, etc.) and would not be suitable for use on an athletic field. One possible solution is the use of UVC from LEDs or optical fibers embedded adjacent the marker lines that are sufficient for energizing the quantum dots, but which do not have sufficient reach/power to be dangerous. Another possible solution, involving near-UV sources, is suitable for indoor applications that use artificial light.

Recently, it has been found that the addition of surface active agents such as suitable electron or hole traps (e.g., by the addition of Zn2+ or excess s-2 ions, respectively) to a monodisperse population of CdS or CdSe quantum dots can also be used to tailor the emission. The use of quantum dots less than or equal to 2 nm allows excitation by sources in the safer near-UV range of 380-420 nm, such as narrow-band blue light used for aquarium/reef lighting. The resulting emissions can then be tuned with surface active agents to obtain the desired color.

Quantum dots are invisible to the naked eye, and can be embedded in paint. In combination with their basic physical capabilities, quantum dots present a way to mark an athletic field with lines for multiple sports, and then selectively display only those lines appropriate for the sport currently being played.

Example

A green artificial turf field is marked with two sets of lines, white for football and yellow for soccer. The football lines are normally visible, but are also embedded with quantum dots that emit green light when energized. The soccer lines are normally invisible (clear), but emit yellow light when energized. The field can be used for football without energizing the quantum dots. To use the field for soccer, the field is exposed to a constant source of excitation energy (UVC, near-UV, RF, etc.). The quantum dots in the football lines emit green light when energized, causing them to become green, blending in with the normal color of the field. The quantum dots in the soccer lines emit yellow light when energized. Only the soccer lines are then visible, thus eliminating confusion for the players and officials.

As an alternative, the football lines are yellow when not energized. It is not strictly necessary for the two sets of lines to be different colors when visible. As in the preceding example, when not energized only the football lines are visible, and when energized only the soccer lines are visible. Again, thus eliminating confusion for the players and officials. It is noted that the visible coloring of the lines may be selected from among many colors that provide good contrast with the green field to human eyes. Orange and red are examples of other colors that may be readily selected for visible colors of marker lines.

Using the tunable absorption properties of quantum dots, multiple colors can be used, each invisible when not energized. Generally, when the field is selectively exposed or not exposed to the specific absorption wavelength appropriate for the required quantum dots, only the lines required for the situation will appear.

FIG. 1 shows a prior art artificial turf athletic field. Lines for multiple sports, in the case of the figure partial football markings and complete soccer markings, are visible at all times. On many fields, markings for three or more sports are always visible.

Figure 2:
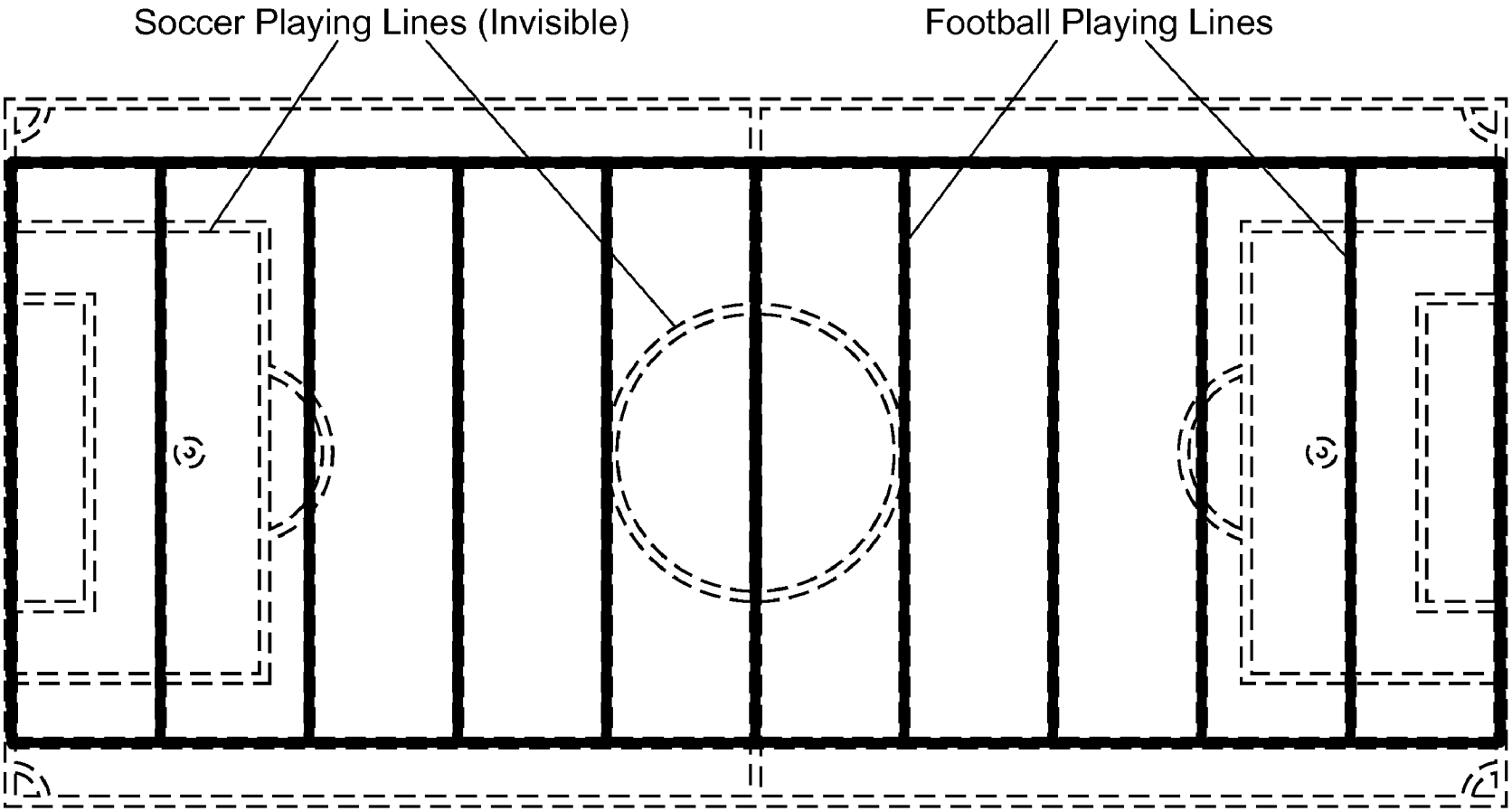
FIG. 2 is a top view of a sports field with markings for multiple sports, painted with quantum dot paint so that only one set of lines are visible.

FIG. 2 shows an artificial turf athletic field with markings painted permanently onto the field using paint containing quantum dots. Under circumstances of no exposure to excitation energy, the partial football markings are visible. The paint for the football markings, however, contains quantum dots that emit green light when energized.

Not visible under circumstance of no exposure to excitation energy are the soccer markings. The paint used for the soccer markings contains quantum dots that emit yellow light when exposed to excitation energy.

Figure 3:
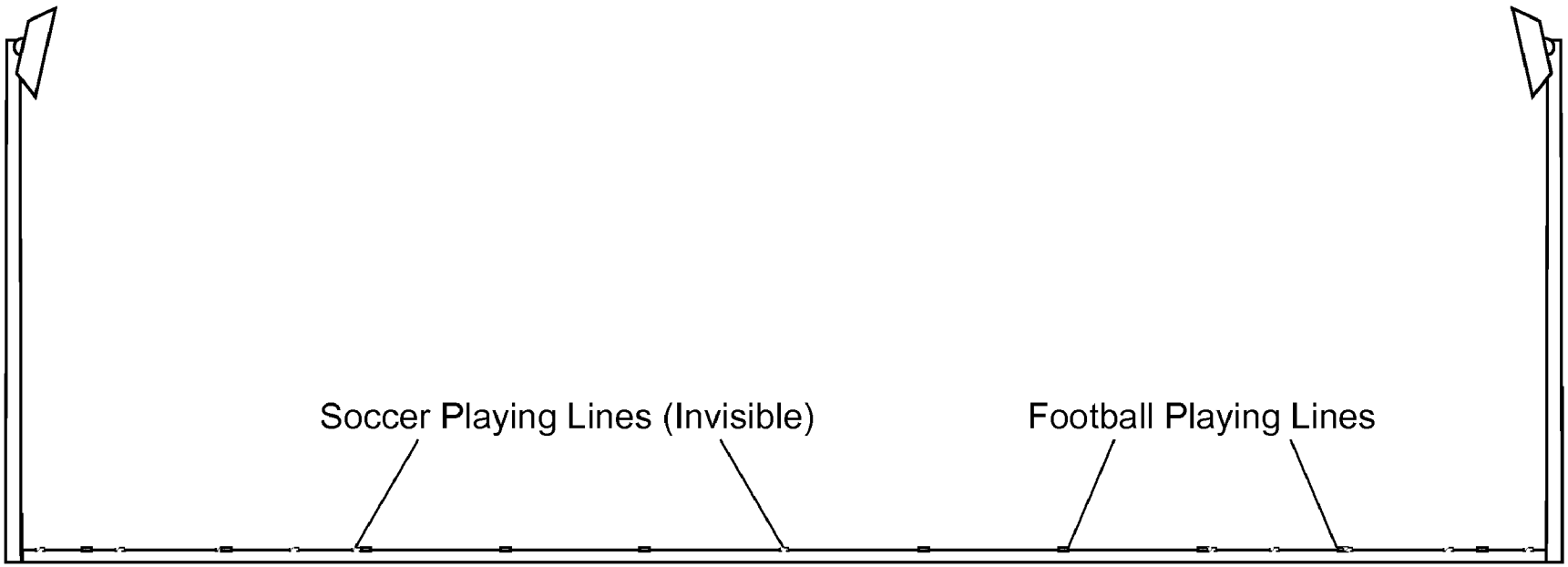
FIG. 3 is a cutaway view of a sports field with near-UV lamps off, lines painted with quantum dot paint.
Figure 4:
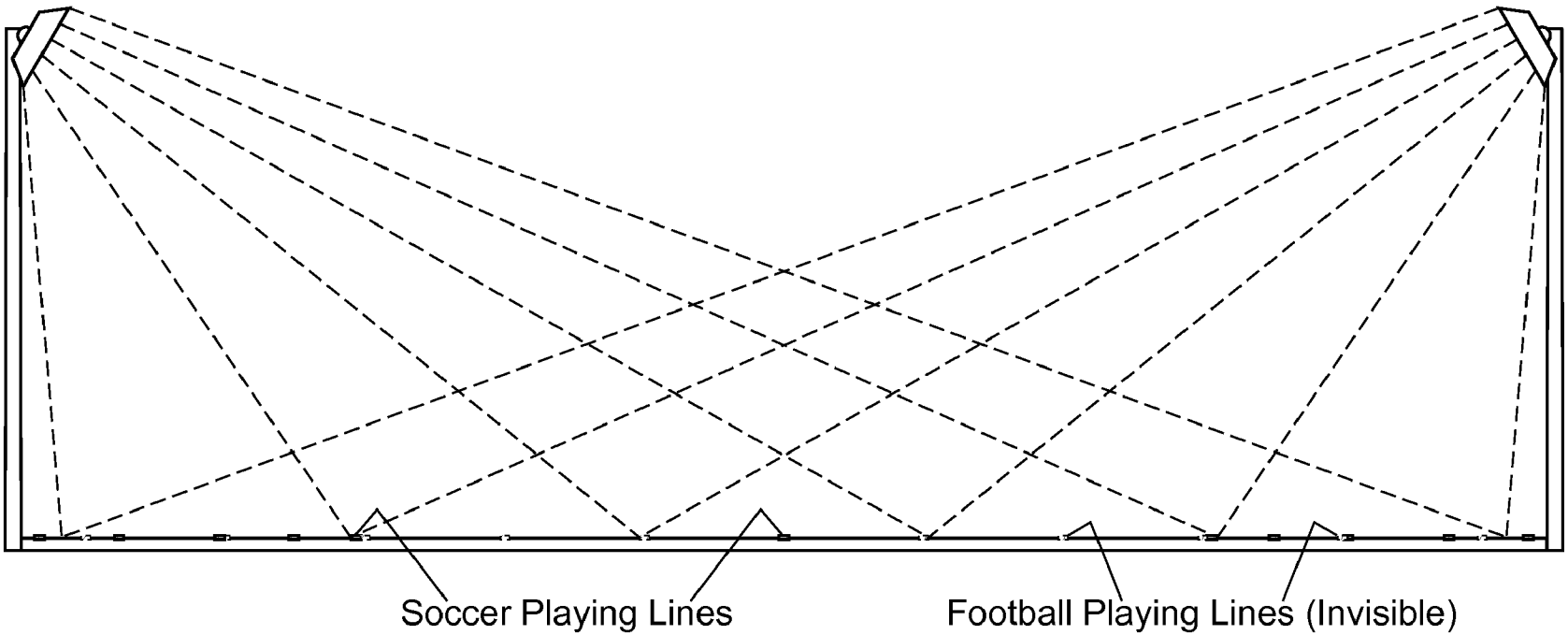
FIG. 4 is a cutaway view of a sports field with near-UV lamps on, lines painted with quantum dot paint.

FIG. 3 shows an artificial turf athletic field from a side view. Mounted on poles along the perimeter of the field are excitation source lamps. These lamps emit excitation energy of in a desired wavelength when turned on. The lamps are mounted high enough to allow for every part of the field to be covered by excitation energy from multiple directions (as shown in FIG. 4), to assure that when the field is energized, no portion of the field surface is at any time be blocked by objects, such as humans, on the field. When used at night or in another artificially lit situation, the excitation source can be near-UV. In sunlit situations, the lamps can be UVC sources, but must be of sufficient power to impact the surface of the field with a continuous power density level of less than 0.1 $\mu W/cm^2$, which is the maximum level allowable for continuous human exposure.

Figure 5:
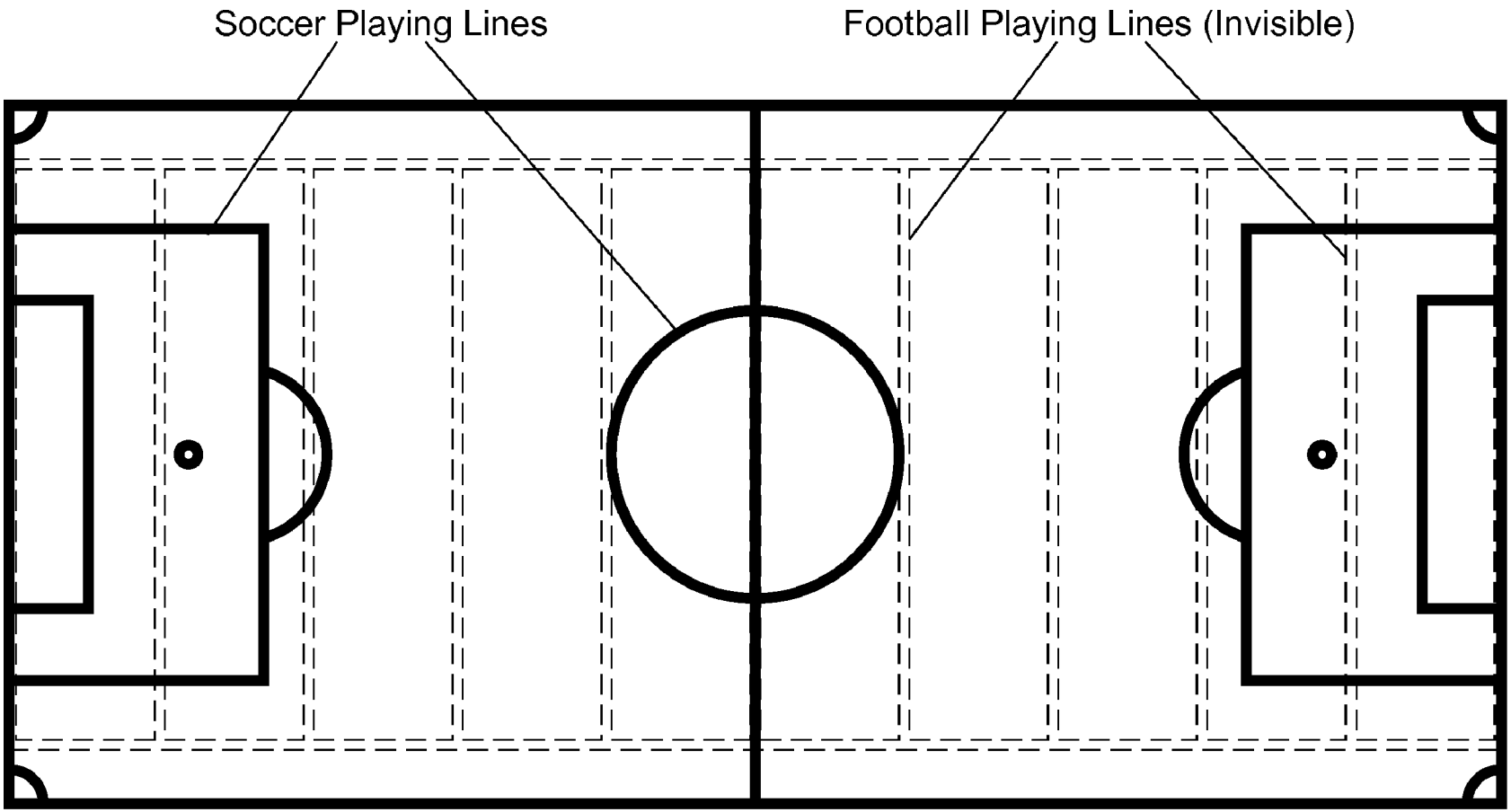
FIG. 5 is a top view of a sports field with markings for multiple sports, near-UV lamps on, painted with quantum dot paint.

FIG. 5 shows an artificial turf athletic field when exposed to UV energy. The quantum dots in the football markings are now emitting green light, making the lines disappear from view. The quantum dots in the soccer markings are not emitting yellow light, making those lines visible.

Figure 6:
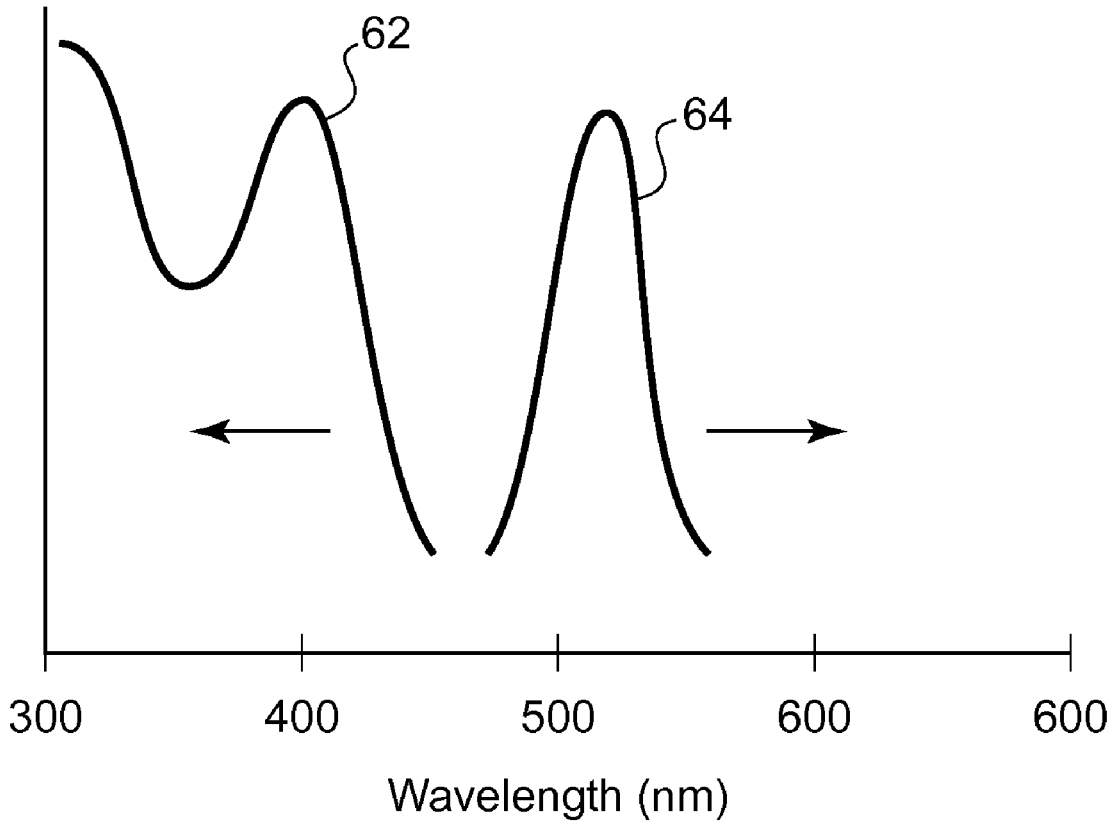
FIG. 6 is a graph showing Stokes shift in smaller quantum dots resulting from decoupling absorption and emission.

FIG. 6 illustrates a desirable absorption and emission graph. The use of small (~1.9 nm) quantum dots with surfactants and surface active agents can achieve significant Stokes shift. In the illustrated graph, near-UV light of approximately 400 nm wavelength is absorbed and green light of approximately 510 nm wavelength is emitted, as would be done to turn an ordinarily white line green.

In situations where more than two sets of markings are desired, or where it is desired that no markings normally be visible, quantum dots with narrow energy absorption ranges can be used. For example, assume three different quantum dots products, each of which absorbs energy in a separate range. By using UV or near-UV lamps that can be tuned or filtered, or multiple sets of such lamps, each set of markings can be turned on separately by exposing the field only to the proper range of UV or near-UV energy.

The improvements to field use and maintenance costs are large. First, all of the confusion caused by multiple lines constantly being visible would be eliminated. Secondly, all lines for all sports could be applied permanently to the field. Using current technology, not all lines for certain sports are permanently applied, as this would leave the field practically covered with markings from some sport. But this requires that some of the markings for various sports must be applied at use time, and in a non-permanent fashion. The proposed solution would eliminate the cost in time and materials needed to prepare a field for a sport.

This concept is universally applicable for the selective display of markings on any object or surface, under any situation where paint can be applied to the object or surface, and the object or surface can be exposed to a controlled source of electromagnetic radiation.

One advantage is elimination of confusion as to what the appropriate markings are for the sport the field is currently being used for, as only the appropriate markings are displayed.

Another advantage is that all field markings can be turned off, discouraging or possibly preventing use of the field when such use is undesired or unauthorized.

Another advantage is that a field can be permanently painted with lines for many different sports, allowing for multiple uses without having to repaint the appropriate markings for the sport.

Another advantage is that a field can be quickly switched between sports without any cost or time delay.

Another advantage is that in the case of a field being used for football, all football markings can be placed on the field. Currently, on most artificial turf field only partial football markings are painted, requiring additional markings be put on the field with temporary materials when the field is used for football.

Another advantage is that confusion as to what the appropriate markings are for an activity are eliminated, as only the appropriate markings are displayed.

Another advantage is that field markings according to the disclosed embodiments can be applied to existing fields at very low cost.

Another advantage is that all markings for all sports can be applied to the field. Currently, not all lines are painted on typical multiple use sports fields (i.e. not all football markings are painted onto the field).

Another advantage is that an object can be permanently painted with markings for many different uses, allowing for multiple uses without having to repaint the appropriate markings for the particular use.

Another advantage is that an object or surface can be quickly switched between uses without any cost or time delay.

Another advantage is that an object (i.e. a bathing suit) can appear different in different environments (i.e. indoor vs. outdoor), based on the prevalence of absorption energy (i.e. UVA) of the quantum dots on the object.

This approach can be applied in many situations beyond outdoor athletic fields. Similar multi-use sports related situations exist in indoor field houses and gymnasiums. In fact, this approach can be applied in any situation where 1) it is desired to mark an object with multiple different markings, 2) it is desirable to be able to select which markings to display at any given time, 3) the object can be painted with permanent paint containing quantum dots, and 4) the object can be exposed to a constant source of the appropriate energy necessary to selectively energize the quantum dots used in the paint on the object.

A simple example is a basketball court where the baskets are lowered and the free-throw line distance is shortened for young players. Presently, tape is typically applied to show the free-throw line, but the edges of the tape can loosen and cause children to trip. In an embodiment, an invisible line can be painted with clear paint that includes quantum dots. When the quantum dots are energized, such as by a near-UV blue light source (e.g., mounted on the backboard) during a children's game or even only when a young shooter is at the foul line for a free-throw, the energized quantum dots will emit a colored light from the clear paint to indicate the location of the shortened free-throw line.

While disclosed herein as being applied to paint used for marking, the quantum dots can be applied in any suitable manner with other materials, including but not limited to, application by inclusion in a coating, a film, an adhesive, an adhesive tape, or a polymer such as artificial turf fibers, carpet fibers, tiles, and panels.

When the selectively marked surface is a gymnasium floor, the markings can be for any of basketball, volleyball, indoor soccer, street hockey, indoor lacrosse, badminton, and tennis. When the selectively marked surface is an athletic field, the markings can be for any of football, baseball, soccer, field hockey, lacrosse, volleyball, and cricket.

A system and a method for selectively marking have been described. It will be understood by those skilled in the art that the present invention may be embodied in other specific forms without departing from the scope of the invention disclosed and that the examples and embodiments described herein are in all respects illustrative and not restrictive. Those skilled in the art of the present invention will recognize that other embodiments using the concepts described herein are also possible. Further, any reference to claim elements in the singular, for example, using the articles "a," "an," or "the" is not to be construed as limiting the element to the singular.

What is claimed is:

1. A method for selectively marking a surface, the method comprising:

marking the surface with lines of a first material containing quantum dots having a first absorption characteristic and a first emission characteristic; and selectively illuminating the surface with radiation consistent with the first absorption characteristic to cause the lines of the first material to display the first emission characteristic.

2. The method of claim 1, further comprising:

marking the surface with lines of a second material containing quantum dots having a second absorption characteristic and a second emission characteristic; and selectively illuminating the surface with radiation consistent with the second absorption characteristic to cause the lines of the second material to display the second emission characteristic.

3. The method of claim 2, wherein the first absorption characteristic and the second absorption characteristic are substantially the same, and the first emission characteristic and the second emission characteristic are different.

4. The method of claim 3, wherein the surface has a surface color and further comprising:

the first material having a first color different from the surface color and the first emission characteristic causing the first material to display substantially the same color as the surface color; and the second material being clear or having substantially the same color as the surface color and the second emission characteristic causing the second material to display a color different from the surface color so as to selectively mark the surface.

5. The method of claim 4, wherein the surface is an athletic playing surface and the lines of the first and second materials correspond to markings for first and second sports.

6. The method of claim 5, wherein the surface is a gymnasium floor and the markings for first and second sports are selected from the group consisting of basketball, volleyball, indoor soccer, street hockey, indoor lacrosse, badminton, and tennis.

7. The method of claim 5, wherein the surface is a an athletic field and the markings for first and second sports are selected from the group consisting of football, baseball, soccer, field hockey, lacrosse, volleyball, and cricket.

8. The method of claim 2, wherein the first absorption characteristic and the second absorption characteristic are different, and the first emission characteristic and the second emission characteristic are substantially the same.

9. A method for selectively marking a surface, the method comprising:

marking the surface with a first coating containing quantum dots having a first absorption characteristic and a first emission characteristic;

marking the surface with a second coating containing quantum dots having a second absorption characteristic and a second emission characteristic; and selectively illuminating the surface with radiation consistent with the first and second absorption characteristic to cause first coating to display the first emission characteristic and the second coating to display the second characteristic.

10. The method of claim 9, wherein the second absorption characteristic is substantially the same as the first absorption characteristic and the first emission characteristic is substantially different than the second emission characteristic.

11. The method of claim 10, wherein the surface has a surface color and further comprising:

the first coating having a first color different from the surface color and the first emission characteristic causing the first coating to display substantially the same color as the surface color; and the second coating being clear or having substantially the same color as the surface color and the second emission characteristic causing the second coating to display a color different from the surface color so as to selectively mark the surface.

12. The method of claim 11, wherein the surface is an athletic playing surface and the first and second coatings correspond to markings for first and second sports.

13. The method of claim 12, wherein the surface is a gymnasium floor and the markings for first and second sports are selected from the group consisting of basketball, volleyball, indoor soccer, street hockey, indoor lacrosse, badminton, and tennis.

14. The method of claim 12, wherein the surface is a an athletic field and the markings for first and second sports are selected from the group consisting of football, baseball, soccer, field hockey, lacrosse, volleyball, and cricket.

15. A system for selectively marking a surface, the method comprising:

a surface;

a first coating on the surface, the first coating comprising quantum dots having a first absorption characteristic and a first emission characteristic;

a second coating on the surface, the second coating comprising quantum dots having a second absorption characteristic and a second emission characteristic; and means for selectively illuminating the surface with radiation consistent with the first and second absorption characteristic to cause first coating to display the first emission characteristic and the second coating to display the second characteristic.

16. The system of claim 15, wherein, the second absorption characteristic being substantially the same as the first absorption characteristic and the first emission characteristic being substantially different than the second emission characteristic.

17. The system of claim 16, wherein the surface has a surface color and further comprising:

the first coating having a first color different from the surface color and the first emission characteristic causing the first coating to display substantially the same color as the surface color; and the second coating being clear or having substantially the same color as the surface color and the second emission characteristic causing the second coating to display a color different from the surface color so as to selectively mark the surface.

18. The system of claim 17, wherein the surface is an athletic playing surface and the first and second coatings are markings for first and second sports.

19. The system of claim 18, wherein the surface is a gymnasium floor and the markings for first and second sports are selected from the group consisting of basketball, volleyball, indoor soccer, street hockey, indoor lacrosse, badminton, and tennis.

20. The system of claim 18, wherein the surface is a an athletic field and the markings for first and second sports are selected from the group consisting of football, baseball, soccer, field hockey, lacrosse, volleyball, and cricket.

* * * * *